US009074762B2

(12) United States Patent
Hase et al.

(10) Patent No.: US 9,074,762 B2
(45) Date of Patent: Jul. 7, 2015

(54) STABILIZING THE FLAME OF A BURNER

(75) Inventors: Matthias Hase, Mülheim (DE); Werner Krebs, Mülheim an der Ruhr (DE); Bernd Prade, Mülheim (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 792 days.

(21) Appl. No.: 13/388,304

(22) PCT Filed: Aug. 2, 2010

(86) PCT No.: PCT/EP2010/061201

§ 371 (c)(1), (2), (4) Date: Apr. 9, 2012

(87) PCT Pub. No.: WO2011/015549

PCT Pub. Date: Feb. 10, 2011

(65) Prior Publication Data

US 2012/0186265 A1 Jul. 26, 2012

(30) Foreign Application Priority Data

Aug. 3, 2009 (EP) ..... 09167055

(51) Int. Cl.

| | |
|---|---|
| ***F23C 9/06*** | (2006.01) |
| ***F23C 9/00*** | (2006.01) |
| ***F23D 11/38*** | (2006.01) |
| ***F23D 14/48*** | (2006.01) |
| ***F23R 3/34*** | (2006.01) |

(52) U.S. Cl.

CPC . *F23C 9/06* (2013.01); *F23C 9/006* (2013.01); *F23C 2202/20* (2013.01); *F23D 11/38* (2013.01); *F23D 14/48* (2013.01); *F23R 3/343* (2013.01); *F23R 2900/03282* (2013.01); *F23C 2202/10* (2013.01)

(58) Field of Classification Search

CPC ..... F23C 9/06; F23C 9/006; F23C 2202/10; F23C 2202/20; F23R 2900/03282; F23R 3/343; F23R 3/286; F23R 3/28; F23D 11/38; F23D 14/48; F23D 17/002

See application file for complete search history.

(56) References Cited

U.S. PATENT DOCUMENTS 2,918,117 A * 12/1959 Griffin ..... 431/116
3,174,526 A * 3/1965 Von Linde ..... 431/116

(Continued)

FOREIGN PATENT DOCUMENTS

CN 1463345 A 12/2003
CN 1878987 A 12/2006

(Continued)

*Primary Examiner* — William H Rodriguez

(57) ABSTRACT

A burner of a gas turbine including a reaction chamber and a plurality of jet nozzles opening into the reaction chamber is provided. Fluid is injected through an outlet into the reaction chamber by the jet nozzles using of a fluid stream wherein the fluid is burned into hot gas in the reaction chamber. An annular gap is disposed about the fluid stream for at least one jet nozzle so that a part of the hot gas is drawn out of the reaction chamber and flows opposite the fluid flow direction into the annular gap and is mixed with the fluid stream within the jet nozzle. The ring gap is formed by means of an insert tube, and wherein the insert rube includes a thickening at the upstream end. A method for stabilizing the flame of such a burner of a gas turbine is also provided.

20 Claims, 6 Drawing Sheets

(56) References Cited

U.S. PATENT DOCUMENTS

| | | | | |
|---|---|---|---|---|
| 3,741,166 | A * | 6/1973 | Bailey | 122/23 |
| 3,927,958 | A * | 12/1975 | Quinn | 431/116 |
| 4,004,875 | A * | 1/1977 | Zink et al. | 431/9 |
| 5,292,244 | A * | 3/1994 | Xiong | 431/189 |
| 5,350,293 | A * | 9/1994 | Khinkis et al. | 431/116 |
| 6,136,279 | A * | 10/2000 | Stahl | 422/625 |
| 2005/0155351 | A1 * | 7/2005 | Wunning et al. | 60/750 |
| 2005/0239005 | A1 * | 10/2005 | Lugnet et al. | 431/8 |
| 2013/0008168 | A1 * | 1/2013 | Hase | 60/733 |
| 2014/0123632 | A1 * | 5/2014 | Shibuya et al. | 60/303 |

FOREIGN PATENT DOCUMENTS

| | | | |
|---|---|---|---|
| DE | 19505614 | A1 | 8/1996 |
| EP | 1950494 | A1 | 7/2008 |

* cited by examiner

STABILIZING THE FLAME OF A BURNER

CROSS REFERENCE TO RELATED APPLICATIONS

This application is the U.S. National Stage of International Application No. PCT/EP2010/061201, filed Aug. 2, 2010 and claims the benefit thereof. The International Application claims the benefits of European Patent Office application No. 09167055.4 EP filed Aug. 3, 2009. All of the applications are incorporated by reference herein in their entirety.

FIELD OF INVENTION

The present invention relates to a burner for stabilizing the flame of a gas turbine, said burner comprising a reaction chamber and a plurality of jet nozzles leading into the reaction chamber, wherein fluid is injected by the jet nozzles into the reaction chamber by means of a fluid jet and wherein the fluid is combusted in the reaction chamber to produce hot gas. The invention also relates to a method for stabilizing the flame of a burner of a gas turbine.

BACKGROUND OF INVENTION

Compared with swirl-stabilized systems, combustion systems based on jet flames afford advantages, in particular from the thermoacoustic perspective, owing to the distributed heat-releasing zones and the absence of swirl-induced turbulence. Through suitable choice of the jet pulse it is possible to generate small-scale flow structures that dissipate acoustically induced heat-releasing fluctuations and thereby suppress pressure pulsations that are typical of swirl-stabilized flames.

The jet flames are stabilized by mixing in hot recirculating gases. The temperatures of the recirculation zone that are necessary for this cannot be guaranteed in gas turbines, in particular in the lower partial load operating range, by the known annular arrangement of the jets with a central recirculation zone. In the partial load operating range in particular, therefore, it must be ensured that partial or complete extinction of the flames is prevented by means of additional stabilization mechanisms. Stabilizing a jet flame consequently remains a problem that has not been entirely resolved.

SUMMARY OF INVENTION

It is therefore the object of the present invention to provide an advantageous burner for a gas turbine for the purpose of stabilizing the flame of such a burner. A further object of the present invention is to provide an advantageous method for stabilizing the flame of such a burner.

The object directed toward the burner is achieved by means of a burner for stabilizing the flame of a gas turbine burner as claimed in the claims. The object directed toward the method is achieved by the disclosure of a method as claimed in the claims. The dependent claims contain further advantageous embodiments of the invention.

In this case the inventive burner of a gas turbine comprises a reaction chamber and a plurality of jet nozzles leading into the reaction chamber. Fluid is injected into the reaction chamber by the jet nozzles by means of a fluid jet. The fluid in the reaction chamber is subsequently combusted to produce hot gas.

The invention has recognized that the combustion systems based on jet flames are stabilized by mixing in hot recirculating gases. Particularly in the lower partial load operating range, however, care must be taken to ensure that partial or complete extinction of the flames is avoided by means of additional stabilization mechanisms.

According to the invention there is now present in the case of at least one jet nozzle an annular gap which is disposed around the fluid jet. This draws some of the hot gas out of the reaction chamber such that the gas flows into the annular gap in the opposite direction to the fluid flow. According to the invention the hot gas is then mixed with the fluid jet inside the jet nozzle. This ensures a defined mixing of hot gases into one or more jets of a jet burner, the latter thereby guaranteeing reliable ignition and consequently reliable stabilization of the burner as a whole. In this case the hot gas is mixed in already in the jet nozzle itself. According to the invention the static pressure differential between combustion chamber/reaction chamber and the fluid flowing at high velocity in the nozzle is used to achieve the suction effect, the fluid having a reduced static pressure due to the high flow velocities.

In a preferred embodiment the annular gap is formed by means of a liner tube. The ingested gases can have a high temperature which under certain conditions may damage the burner. Preferably, therefore, the liner tube is fabricated at least in part from high-quality materials with and without coating, e.g. as a ceramic implementation with and without coating.

Preferably the liner tube has at least one orifice for the purpose of injecting the hot gas into the fluid jet. In a preferred embodiment the at least one orifice is disposed upstream. The hot gas is sucked in through the annular gap directly into the nozzle and injected through the orifices into the fluid jet. The orifices are therefore incorporated in the wall directly delimiting the fluid jet. In this case the size of the orifices and the height of the annular gap are dimensioned such that a good mixing of hot gas into the air or the air/fuel mixture in the jet nozzle is ensured and that in the partial load operating range the temperature of the mixture is brought to a value which guarantees reliable ignition. The orifices can be embodied in the form of boreholes or slots which can also be inclined at an angle.

In a preferred embodiment the liner tube has a thicker section at the upstream end. This enables deflection losses to be avoided when compressor air with or without fuel as fluid is directed past the liner tube to the nozzle. Advantageously the thicker section is embodied as diffuse in the flow direction. In this way an increase can be effected in the static pressure differential between the combustion chamber and the fluid flowing at high velocity in the nozzle.

Preferably the liner tube is embodied as diffuse in the flow direction on the fluid flow side. This likewise enables an increase to be effected in the static pressure differential between the combustion chamber and the fluid flowing at high velocity in the nozzle.

In an advantageous embodiment a second annular channel is provided around the liner tube for the purpose of ducting combustion air and/or fuel. Means for increasing the transfer of heat are advantageously provided in the second annular channel. This results in efficient cooling of the hot-gas-conducting liner tube. Preferably said means are dimples and/or cooling fins and/or wings, although all other cooling concepts in which the compressor air or the compressor/fuel mixture is directed into the reaction chamber, such as impingement cooling or convective cooling, are also conceivable. In a preferred embodiment the cooling air and/or fuel flowing through the second annular channel accordingly cools the liner tube on the fluid outflow side.

Advantageously the jet nozzle has a nozzle outlet with diameter D. Preferably the nozzle outlet is disposed offset with respect to the annular gap in the flow direction. Advantageously the offset has a length of 0-3× the diameter of the nozzle outlet. This ensures an optimal suction effect, particularly in partial load operation.

In a preferred embodiment the fluid is compressor air which has been premixed, partially premixed or not premixed with fuel.

The object directed toward the method is achieved by the disclosure of a method for stabilizing the flame of a gas turbine burner which comprises a reaction chamber and a plurality of jet nozzles leading into the reaction chamber, wherein fluid is injected into the reaction chamber by the jet nozzles by means of a fluid jet, and wherein the fluid is combusted in the reaction chamber, as a result of which a hot gas is produced.

According to the invention there is present in the case of at least one jet nozzle an annular gap through which some of the hot gas is ingested and flows into the annular gap in the opposite direction to the fluid flow and is admixed to the fluid jet inside the jet nozzle.

Preferably the fluid flows at high velocity into the reaction chamber. A pressure differential is advantageously formed between the reaction chamber and the fluid jet flowing into the reaction chamber.

During partial load operation of the burner the fluid is preferably formed from a fuel/compressor air mixture, and at full load it is formed from compressor air having only a negligible fuel fraction or none at all. Accordingly, said nozzles act in partial load operation as pilot burners with pilot jets. For this purpose it may be additionally advantageous for said "pilot jets" to be implemented smaller in size than the other jets so that less air passes through said nozzles. In this way stabilization is guaranteed during partial load operation.

It is furthermore advantageous for the burner to be embodied with a plurality of jet nozzles, although only one or just a few of these are nozzles according to the invention. At partial load said nozzles then act as "pilots", as described above, and are charged with little or even no fuel during full load operation. This avoids increased NOx values being produced during basic load operation.

BRIEF DESCRIPTION OF THE DRAWINGS

Further features, characteristics and advantages of the present invention are described below with reference to exemplary embodiments taken in conjunction with the accompanying figures, in which.

DETAILED DESCRIPTION OF INVENTION

Figure 1:
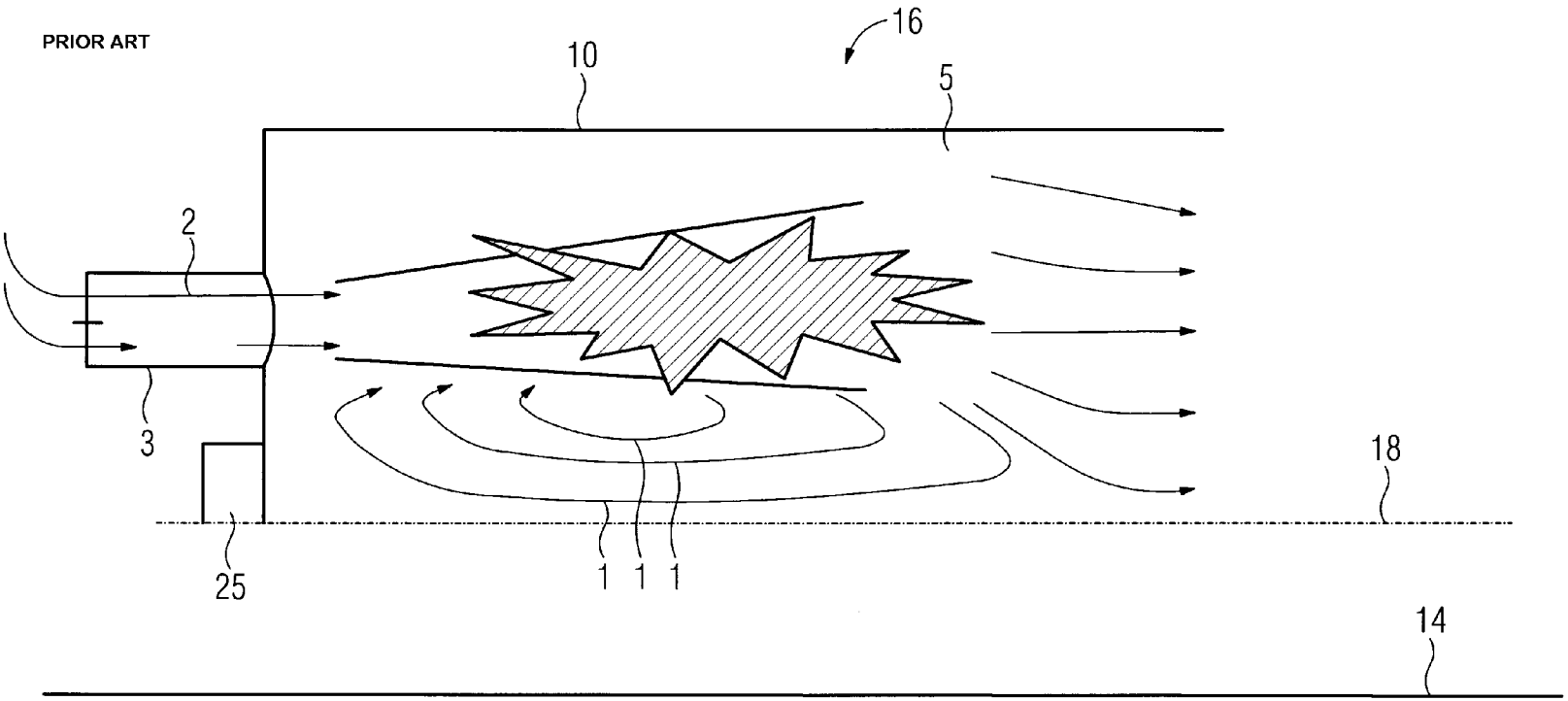
FIG 1 PRIOR ART
FIG. 1 shows a detail from a gas turbine comprising a combustion chamber in a longitudinal section along a shaft axis according to the prior art, FIG. 2 schematically shows a section through a jet burner at right angles to its longitudinal direction, FIG. 3 schematically shows a section through a further jet burner at right angles to its longitudinal direction, FIG. 4 schematically shows a first exemplary embodiment of a nozzle 6 according to the invention, FIG. 5 schematically shows a second exemplary embodiment of a nozzle 6*a* according to the invention, FIG. 6 schematically shows a third exemplary embodiment of a nozzle 6*b* according to the invention, and FIG. 7 schematically shows a fourth exemplary embodiment of a nozzle 6*c* according to the invention.

FIG. 1 shows a detail from a gas turbine having a shaft (not shown) disposed along a shaft axis 14 and a combustion chamber 16 aligned in parallel with the shaft axis 14 in a longitudinal section. The combustion chamber 16 is constructed as a rotationally symmetrical structure around a combustion chamber axis 18. In this specific exemplary embodiment the combustion chamber axis 18 is disposed in parallel with the shaft axis 14, though it can also run at an angle to the shaft axis 14, in the extreme case vertically with respect to the latter. A ring-shaped housing 10 of the combustion chamber 16 encloses a reaction chamber 5 which is likewise implemented as a rotationally symmetrical structure around the combustion chamber axis 18. An air or air/fuel mixture is introduced into the reaction chamber 5 by means of a jet nozzle 3 according to the prior art. The recirculating hot gases 4 in the reaction chamber are indicated by reference numeral 1.

Figure 2:
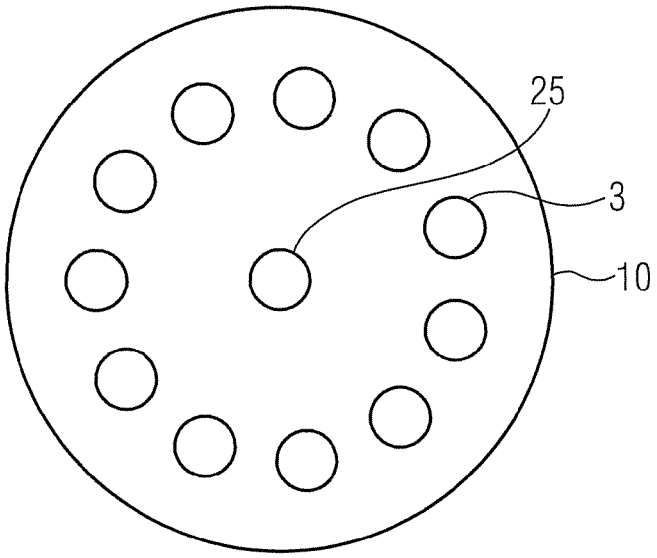

FIG. 2 schematically shows a section through a jet burner vertically with respect to a shaft axis 14 of the burner. The burner comprises a housing 10 having a circular cross-section. A specific number of jet nozzles 3 are arranged essentially in a ring shape inside the housing 10. Each jet nozzle 3 in this arrangement has a circular cross-section. The burner can also include a pilot burner 25.

Figure 3:
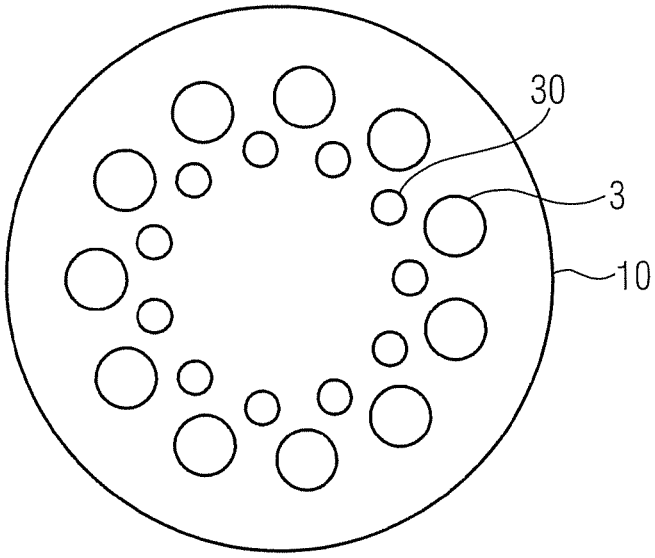

FIG. 3 schematically shows a section through a further jet burner, the section running vertically with respect to the central axis 14 of the further burner. The burner likewise has a housing 10 which possesses a circular cross-section and in which a number of inner and outer jet nozzles 3,30 are arranged. Each of the jet nozzles 3,30 has a circular cross-section, with the outer jet nozzles 3 possessing a cross-sectional area equal to or greater than that of the inner jet nozzles 30. The outer jet nozzles 3 are arranged essentially in a ring shape inside the housing 10 and form an outer ring. The inner jet nozzles 30 are likewise arranged in a ring shape inside the housing 10. The inner jet nozzles 30 form an inner ring which is arranged concentrically with respect to the outer jet nozzle ring.

FIGS. 2 and 3 merely show examples of the arrangement of jet nozzles 3,30 inside a jet burner. It is self-evident that alternative arrangements are possible, as also is the use of a different number of jet nozzles 3,30.

Compared with swirl-stabilized systems, the combustion systems based on jet flames afford advantages, in particular from the thermoacoustic perspective, owing to the distributed heat-releasing zones and the absence of swirl-induced turbulence. Through suitable choice of the jet pulse it is possible to generate small-scale flow structures that dissipate acoustically induced heat-releasing fluctuations and thereby suppress pressure pulsations that are typical of swirl-stabilized flames. The combustion systems based on jet flames are stabilized by mixing in hot recirculating gases. Particularly in the lower partial load operating range, however, care must be taken to ensure that partial or complete extinction of the flames is avoided by means of additional stabilization mechanisms. This is now achieved with the aid of the invention.

Figure 4:
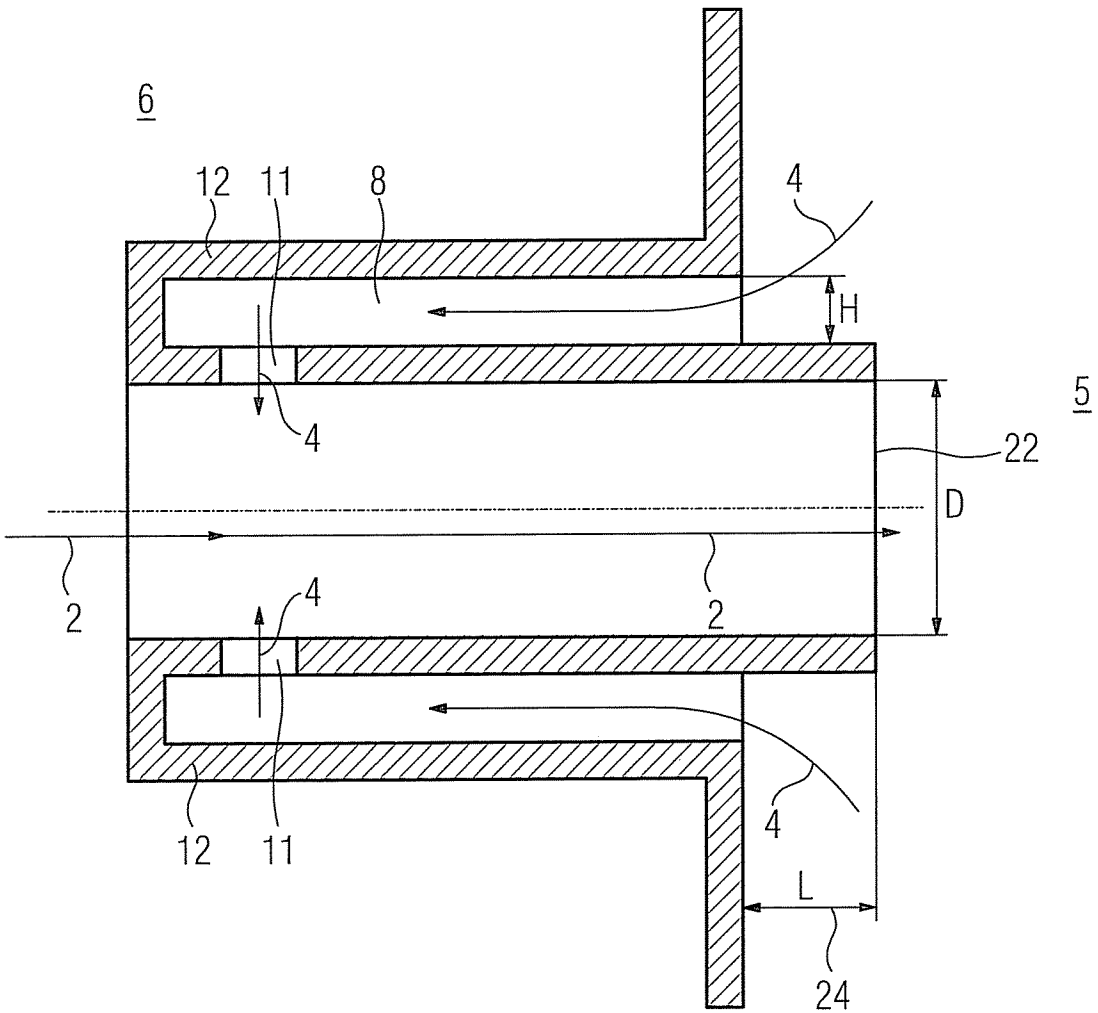

FIG. 4 shows a jet nozzle 6 according to the invention. In this case the burner comprises a reaction chamber 5 and a plurality of jet nozzles 6 leading into the reaction chamber 5. Fluid is injected by the jet nozzle into the reaction chamber 5 by means of a fluid jet 2. The fluid is combusted in the reaction chamber 5, producing hot gas 4.

In this case the fluid can be a fuel/air mixture or else be formed purely from compressor air.

An annular gap is now present in the jet nozzle 6. Said gap is formed from a liner tube 12. Accordingly, the annular gap 8 is disposed around the fluid jet 2. Hot gas 4 is now sucked into the nozzle 6 through said annular gap 8. In order to ingest the hot gas 4, the—in particular static—pressure differential between the combustion chamber 16 or the reaction chamber 5 and the fast-flowing fluid is exploited, the fluid having a reduced static pressure due to the high flow velocities. Hot gas 4 now streams back through the annular gap 8 into the nozzle 6 against the flow direction of the fluid jet 2 in the nozzle 6. There, the hot gas 4 is admixed to the fluid jet 2.

According to the invention the hot gas is therefore admixed inside the nozzle 6. This is equivalent to a defined mixing-in of hot gas in the nozzle 6, as a result of which reliable ignition and consequently reliable stabilization of the burner as a whole are ensured.

The stabilization is advantageous in particular during partial load operation. According to the invention only one or a few nozzles 6 of a jet burner can therefore be embodied with said device for ingesting hot gas 4. In partial load operation said nozzles can act as pilot burners. The fluid can be a fuel/air mixture in this case. For this purpose it may additionally be advantageous for said "pilot jets" to be implemented smaller in size than the other jets, so that less compressor air passes through said nozzles 6. In full load operation or operation close to full load the fluid is charged with only a little fuel or even none at all. In this case the fluid can then consist essentially of compressor air. Accordingly, increased NOx values during basic load operation are avoided.

In this arrangement the hot gas is sucked in via the annular gap 8. The latter is faulted by means of a liner tube 12. One or more orifices 11 are formed upstream in the liner tube 12, enabling the hot gas 4 to be admixed to the fluid jet 2. The orifices 11 are disposed on the jet side in the liner tube 12, which is to say in the wall delimiting the fluid jet. The orifices 11 can be embodied therein as boreholes.

The size of the orifices 11 and the radial height H of the annular gap 8 are in this case dimensioned such that a good mixing of hot gas into the fluid jet 2 in the jet nozzle 6 is ensured.

The nozzle 6 additionally has a nozzle outlet 22 with diameter D. The nozzle outlet 22 can be arranged offset with respect to the annular gap 8 in the flow direction. Preferably the offset 24 has a length L of 0 mm-3×D (mm), where D is the diameter of the nozzle outlet 22.

Specifically in the partial load operating range the temperature of the mixture is thus brought to a value which guarantees reliable ignition and consequently reliable stabilization of the burner as a whole in all operating ranges.

In this case the fluid jet 2 can consist of an air/fuel mixture of different mixture quality. The jet flame itself may have been premixed, partially premixed or not premixed.

Figure 5:
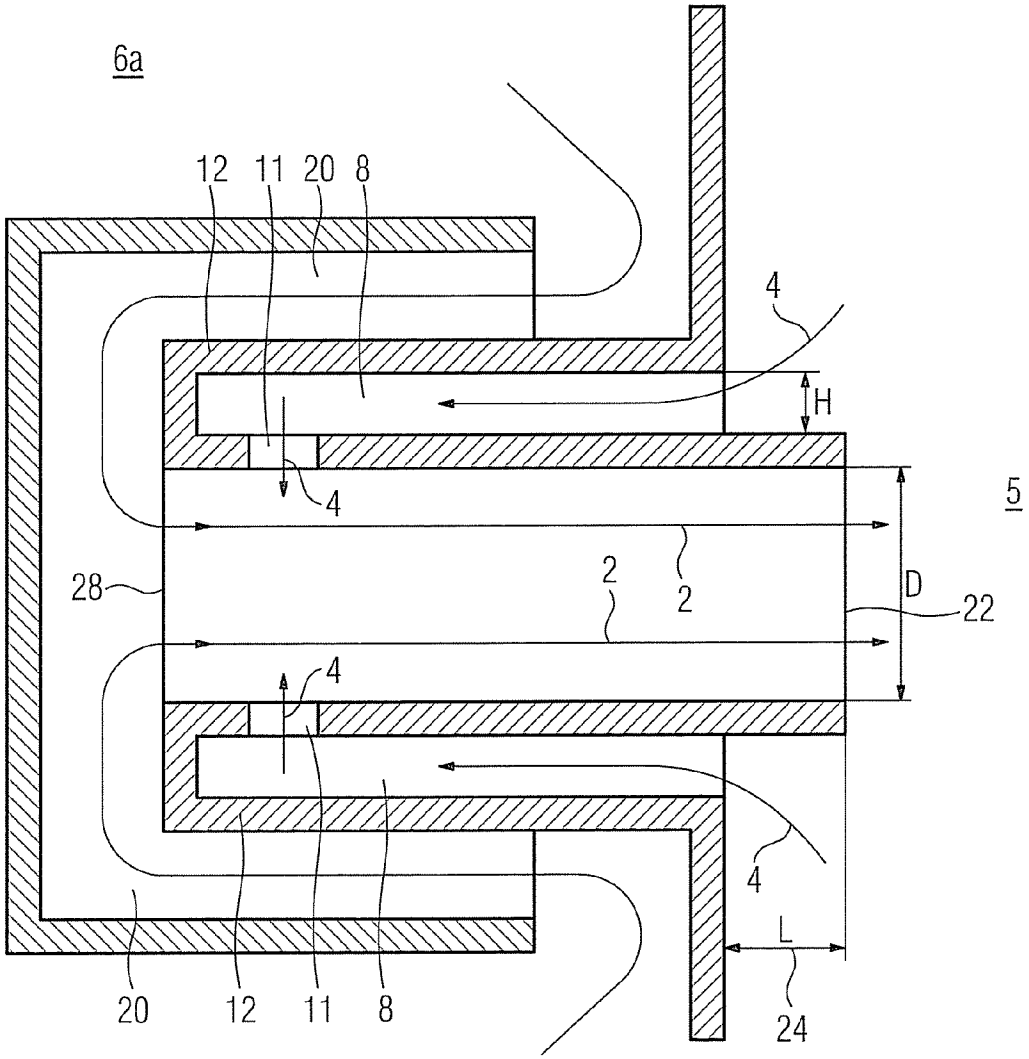

FIG. 5 shows a further second exemplary embodiment of a nozzle 6*a* according to the invention. In this arrangement a second annular channel 20 is present which is disposed around the annular gap 8. Said annular channel 20 can be embodied essentially for the purpose of ducting the compressor air or the air/fuel mixture to the nozzle inlet 28. The combustion air or the fuel/air mixture can be used for cooling in particular the radially outer wall of the liner tube 12. This is advantageous, since the ingested gases have a high temperature which otherwise may potentially damage the burner. The annular channel 20 may additionally be implemented using measures aimed at increasing the transfer of heat. That is, means for increasing the transfer of heat (such as schematically represented by structural feature 21 in FIG. 5) may be provided in the second annular channel 20. These can be, for example, dimples and/or wings and/or cooling fins, as well as convective or impingement cooling or other conventional cooling concepts in which the compressor air embodied as cooling air or the air/fuel mixture is discharged into the reaction chamber 5. Accordingly, the compressor air or the air/fuel mixture is used for cooling the hot-gas-conducting components while simultaneously providing preheating.

The hot-gas-conducting passages, i.e. in particular the liner tube 12, can also be made from high-quality materials, e.g. from ceramic or ceramic-containing materials, in which case the materials may additionally be coated.

Figure 6:
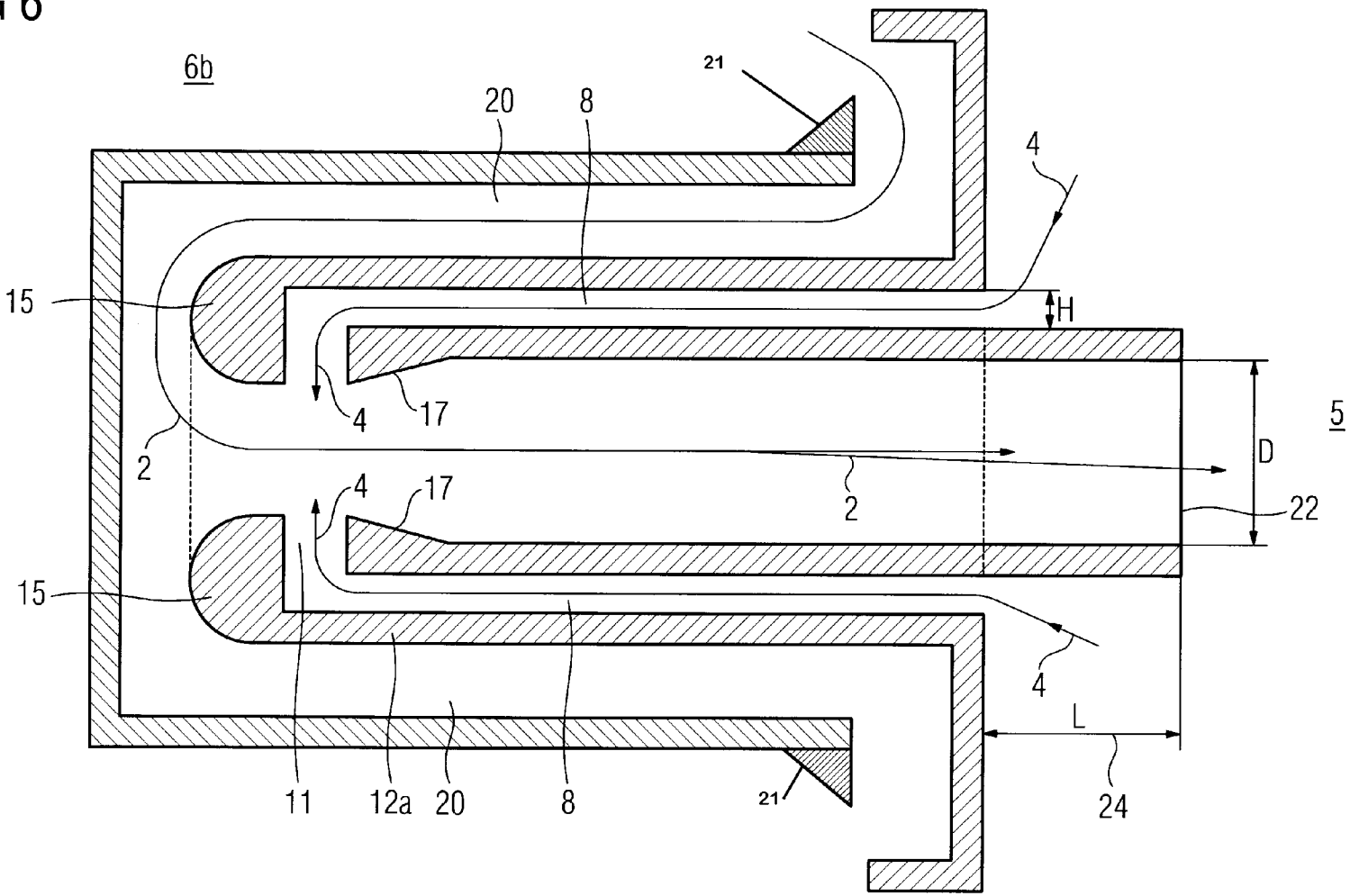
Figure 7:
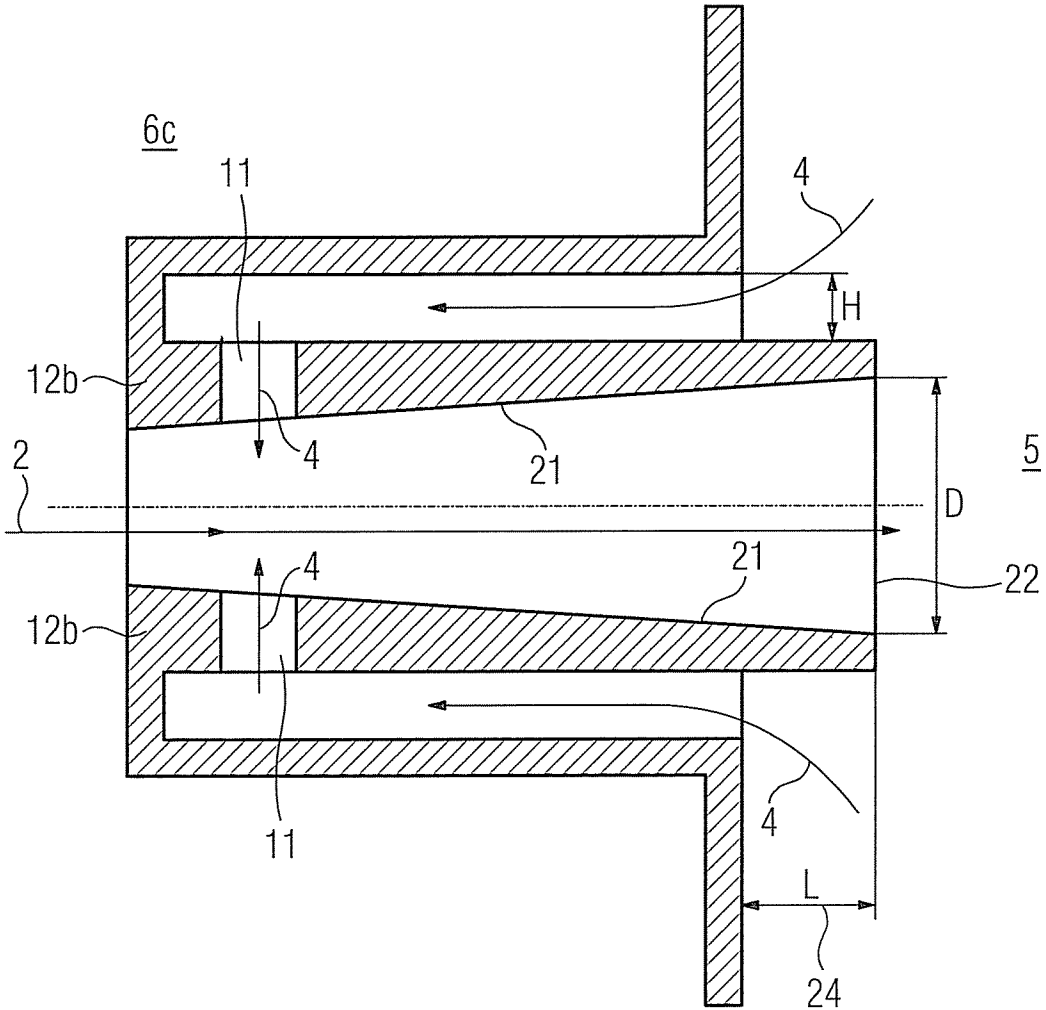

FIG. 6 and FIG. 7 show further exemplary embodiments of a nozzle 6*b* and 6*c* according to the invention. The figures depict nozzles which in particular increase the static pressure differential between the combustion chamber 16 or the reaction chamber 5 and the fluid jet flow 2 at the level of the mixing-in point.

FIG. 6 shows a liner tube 12*a* which has a thicker section 15 at the upstream end. In this case the thicker section 15 is embodied as rounded. This advantageously avoids deflection losses of the compressor air or the fuel/air mixture in the annular channel 20. The thicker section 15 can also be embodied as diffuse 16 in the flow direction. This results in a particularly efficient increase in pressure differential. In this case the orifices 11 can also be implemented as slots which where appropriate are inclined at an angle.

FIG. 7 illustrates a nozzle 6*c* in which the liner tube 12*b* is embodied as diffuse 21 on the fluid flow side in the flow direction. In this case, too, the result is a particularly efficient increase in pressure differential.

With the invention presented here, therefore, reliable ignition and consequently reliable stabilization of the burner as a whole are ensured. With this approach, ingested hot gases 4 are sucked in via an annular gap 8 around the actual jet, i.e. the fluid jet 2, and admixed to said jet 2 inside the nozzle 6. In this solution the static pressure differential between combustion chamber and fluid jet flow is used as the driving force. Such stabilization is important in particular during partial load operation.

The invention claimed is:

1. A burner for a gas turbine, comprising:

a reaction chamber;

a plurality of jet nozzles leading into the reaction chamber; and a liner tube, wherein fluid is injected through an outlet by the plurality of jet nozzles into the reaction chamber by means of a fluid jet, the fluid being combusted in the reaction chamber to produce hot gas, wherein at least one jet nozzle includes an annular gap which is disposed around the fluid jet such that some of the hot gas is drawn out of the reaction chamber and flows into the annular gap in the opposite direction to the fluid flow and is mixed with the fluid jet inside the jet nozzle, wherein the annular gap is formed by means of the liner tube, and wherein the liner tube has a thicker section at the upstream end.

2. The burner as claimed in claim 1, wherein the liner tube includes an orifice for the purpose of injecting the hot gas into the fluid jet.

3. The burner as claimed in claim 2, wherein the orifice is disposed upstream of the outlet.

4. The burner as claimed in claim 1, wherein the liner tube is embodied as a diffuser on the fluid flow side in the flow direction.

5. The burner as claimed in claim 1, wherein the thicker section is embodied as a diffuser in the flow direction.

6. The burner as claimed in claim 1, wherein a second annular channel is provided around the liner tube for the purpose of ducting combustion air and/or fuel.

7. The burner as claimed in claim 6, wherein means for increasing the transfer of heat are provided in the second annular channel.

8. The burner as claimed in claim 7, wherein the means for increasing the transfer of hear are selected from the group consisting of dimples, cooling fins, wings, and a combination thereof.

9. The burner as claimed in claim 7, wherein the air and/or fuel thus flowing through the second annular channel cools the liner tube on the fluid outflow side.

10. The burner as claimed in claim 1, wherein the jet nozzle includes a nozzle outlet with diameter.

11. The burner as claimed in claim 10, wherein the nozzle outlet is arranged offset with respect to the annular gap in the flow direction.

12. The burner as claimed in claim 11, wherein the offset includes a length of 0 mm-3× diameter mm.

13. The burner as claimed in claim 1, wherein the fluid is compressor air which has been premixed.

14. The burner as claimed in claim 1, wherein the fluid is compressor air which has been partially premixed.

15. The burner as claimed in claim 1, wherein the fluid is compressor air which has not been premixed with fuel.

16. A method for stabilizing the flame of a gas turbine burner which comprises a reaction chamber and a plurality of jet nozzles leading into the reaction chamber, the method comprising:

injecting fluid into the reaction chamber using the jet nozzles by means of a fluid jet, the fluid being combusted in the reaction chamber, as a result of which a hot gas is produced, wherein an annular gap is disposed in at least one jet nozzle, wherein the annular gap is faulted by means of a liner tube, and wherein the liner tube has a thicker section at the upstream end, with some of the hot gas being sucked in through the annular gap and flowing into the annular gap in the opposite direction to the fluid flow and being admixed to the fluid jet inside the jet nozzle.

17. The method as claimed in claim 16, wherein the fluid flows at high velocity into the reaction chamber.

18. The method as claimed in claim 16, wherein a pressure differential is formed between the reaction chamber and the fluid jet flowing into the reaction chamber.

19. The method as claimed in claim 16, wherein in a partial load operation of the burner the fluid is formed from a fuel/compressor air mixture.

20. The method as claimed in claim 16, wherein at full load the fluid is formed from compressor air having only a negligible fuel fraction or none at all.

* * * * *